United States Patent [19]

Yoshimoto et al.

[11] Patent Number: 4,546,043

[45] Date of Patent: Oct. 8, 1985

[54] HOLLOW IRREGULAR MULTIFILAMENT YARN AND PROCESS AND SPINNERET FOR PRODUCING THE SAME

[75] Inventors: Masato Yoshimoto; Shinji Ohwaki, both of Ibaraki, Japan

[73] Assignee: Teijin Limited, Osaka, Japan

[21] Appl. No.: 692,386

[22] Filed: Jan. 17, 1985

[30] Foreign Application Priority Data

Jan. 18, 1984 [JP] Japan ..... 59-5699
Feb. 29, 1984 [JP] Japan ..... 59-36097

[51] Int. Cl.[4] ..... D02G 3/00

[52] U.S. Cl. ..... 428/397; 428/364; 428/373; 428/398; 264/171; 264/177 F

[58] Field of Search ..... 428/373, 374, 397, 398, 428/399, 369, 370; 57/243, 248; 264/177 F, 171, 173

[56] References Cited

U.S. PATENT DOCUMENTS

| | | | |
|---|---|---|---|
| 4,059,950 | 11/1977 | Takao et al. | 428/399 |
| 4,316,924 | 2/1982 | Minemura et al. | 428/398 |
| 4,332,757 | 6/1982 | Blackmon | 264/177 F |
| 4,351,147 | 9/1982 | Blackmon et al. | 264/177 F X |
| 4,405,686 | 9/1983 | Kuroda et al. | 264/177 F X |
| 4,414,801 | 11/1983 | Blackmon et al. | 264/177 F X |
| 4,489,543 | 12/1984 | Bromley et al. | 57/208 |

FOREIGN PATENT DOCUMENTS

| | | | |
|---|---|---|---|
| 2842949 | 12/1979 | Fed. Rep. of Germany | 264/177 F |
| 19-899 | 1/1944 | Japan | 264/177 F |
| 47-37207 | 9/1972 | Japan | 264/177 F |

*Primary Examiner*—Lorraine T. Kendell
*Attorney, Agent, or Firm*—Burgess, Ryan & Wayne

[57] ABSTRACT

A synthetic polymer hollow irregular multifilament yarn useful for producing bulky yarn products comprises a plurality of hollow irregular individual filaments each comprising a hollow filamentary constituent, a non-hollow sinuous filamentary constituent sinuously extending in a wave form along the hollow filamentary constituent, having a smaller average thickness than the hollow filamentary constituent and being connected to one side of the hollow filamentary constituent through a middle filamentary constituent distortedly extending along the hollow filamentary constituent and having a cross-sectional profile in the form of a waist, and is produced by extruding at least one polymer melt through a spinneret having a plurality of spinning orifices each consisting of a first orifice segment adequate for forming a hollow filament, a second orifice segment adequate for forming a non-hollow filament and having a smaller cross-section than that of the first orifice segment and a third orifice segment in the form of a slit connected to both the first and second orifice segments, by cooling the extruded hollow irregular filamentary streams to solidify them and by taking up the resultant hollow irregular multifilament yarn.

16 Claims, 22 Drawing Figures

HOLLOW IRREGULAR MULTIFILAMENT YARN AND PROCESS AND SPINNERET FOR PRODUCING THE SAME

BACKGROUND OF THE INVENTION

1. Field of the Invention

The present invention relates to a synthetic polymer hollow irregular multifilament yarn capable of being converted to a bulky yarn, a process and a spinneret for producing the same.

More particularly, the present invention relates to a synthetic polymer hollow irregular multifilament yarn in which each of the individual filaments is composed of three filamentary segments having a different longitudinal shrinking property, and as a whole, the longitudinal shrinking property of each individual filament varies along the longitudinal axis of the filament, and a process and a spinneret for producing the same.

2. Description of the Related Art

It is known that a synthetic polymer multifilament yarn capable of being converted to a bulky yarn by heating the yarn is obtained by blending two or more types of filaments each having a different heat shrinking property. This type of technology is disclosed, for instance, in U.S. Pat. No. 3,200,576 for S. B. Maerow et al.

When the above-mentioned type of blended multifilament yarn is heated, the filaments having a high heat shrinking property shrink at a high shrinkage, causing the remaining filaments having a low heat shrinking property to bulge from the high shrunk filaments, and therefore, causing the yarn to become bulky.

In this type of the blended multifilament yarn, if the high shrinkage filaments have a larger denier than that of the low shrinkage filaments, the resultant bulky yarn usually exhibits a satisfactory rigidity and a soft touch.

As stated above, the multifilament yarn useful for producing a bulky yarn can be produced by blending at least two types of filaments each having a different shrinking property, for instance, in accordance with the process as disclosed in U.S. Pat. No. 4,153,660.

In the process of the U.S. patent, a number of undrawn filaments are produced by extruding a polymer melt through a spinneret having a number of spinning orifices. The resultant filaments are divided into two groups. A first finishing agent-containing aqueous liquid is applied to the first group of filaments and a second finishing agent-containing liquid having a higher boiling temperature than that of water is applied to the second group of filaments. The first and second groups of filaments are drawn separately at an elevated temperature under the same conditions. The first and second groups of the drawn filaments are then blended to provide a multifilament yarn.

The difference in the boiling temperatures of the first and second finishing agent-containing liquids results in a difference in the shrinking property of the first and second groups of drawn filaments. However, this process is disadvantageous in that a number of complicated procedures are necessary and two different finishing agents must be used.

In the melt-spinning process in which a plurality of filaments each having a different thickness are produced by using a single spinneret, the extruded filamentary streams are laterally oscillated and frequently adhere to each other, and thus, are sometimes broken. Therefore, in this process, it is very important to strictly control the draft applied to the filaments, and the amount, blowing rate, and direction of the cooling air applied to the filaments. This process is, therefore, complicated and inconvenient. U.S. Pat. Nos. 4,332,757 and 4,349,604 for L. E. Blackmon et al disclose a rather simple process for producing multifilament yarn capable of being converted to a bulky yarn without using complicated procedures.

In this process, a polymer melt is extruded through a pair of spinning orifices having extruding directions crossing each other at an angle, and extruding openings having different areas. A portion of the polymer melt is extruded through the large orifice at a lower extruding rate than that at which the remaining portion of the polymer melt is extruded through the small orifice. The resultant thin filamentary stream of the polymer melt extruded through the small orifice at a high extruding rate travels a sinuous path in a wave form and is combined with the resultant thick filamentary stream of the polymer melt extruded through the large orifice at a low extruding rate, which thick filamentary stream travels substantially straight. The resultant irregular filamentary stream is cool-solidified and is then taken up. This resultant irregular filament is composed of a thick filamentary segment which extends substantially straight and has a high shrinking property, and a thin filamentary segment sinuated in a wave form and combined to the thick filamentary segment and having a low shrinking property. The longitudinal shrinking property of the irregular filament varies along the length thereof.

The resultant multifilament yarns are converted to a woven or knitted fabric, and the fabric is then heat treated so that the multifilament yarns in the fabric are converted to bulky yarn. However, the heat-treated fabric, particularly the heat treated woven fabric consisting of the above-mentioned conventional irregular multifilament yarns, has an unsatisfactory bulkiness.

Usually, the above-mentioned type of conventional irregular filaments exhibit a relatively poor shrinking force when they are heated. Therefore, when the conventional irregular multifilament yarns are woven into a woven fabric, the heat-shrinkage of the individual filaments in the yarns is restricted by the weave structure. Therefore, the resultant heat-treated woven fabric exhibits an unsatisfactory bulkiness.

Also, when the above-mentioned conventional multifilament yarn is drawn, the difference in shrinking property between the thick straight filamentary segments and the thin sinuous filamentary segments tends to disappear. Accordingly, the conventional multifilament yarn must be used without being drawn. This necessity sometimes, causes the resultant bulky fabric to have an uneven shrinkage and/or dyeing property. Therefore, conditions adequate for dyeing and finishing the conventional irregular multifilament yarn fabrics are strictly limited.

Accordingly, the practical use of the above-mentioned irregular multifilament yarn is strictly restricted.

SUMMARY OF THE INVENTION

An object of the present invention is to provide a synthetic polymer hollow irregular multifilament yarn capable of being converted to a bulky yarn having an even shrinking property, dyeing property, and bulkiness, and a process and a spinneret for producing the same.

Another object of the present invention is to provide a synthetic polymer hollow irregular multifilament yarn capable of being converted to a bulky yarn even after a drawing procedure is applied to the yarn for imparting enhanced mechanical properties thereto, and a process and a spinneret for producing the same.

Still another object of the present invention is to provide a synthetic polymer hollow irregular multifilament yarn capable of being converted to a bulky yarn having a satisfactory rigidity and soft touch, and a process and a spinneret for producing the same.

The above-mentioned objects can be attained by the synthetic polymer hollow irregular multifilament yarn of the present invention, which yarn consists of a plurality of hollow irregular individual filaments, each of which filaments comprises (A) a hollow filamentary constituent extending along the longitudinal axis of the filament and having at least one hollow extending therealong;

(B) a non-hollow filamentary constituent sinuously extending in a wave form along the hollow filamentary constituent (A) and having an average thickness smaller than that of the hollow filamentary constituent (A); and (C) a middle filamentary constituent distortedly extending along the hollow filamentary constituent (A), while connecting therethrough the non-hollow sinuous filamentary constituent (B) to one side of the hollow filamentary constituent (A) to provide a body of a hollow irregular filament having an uneven thickness varying along the longitudinal axis of the filament and having a cross-sectional profile in the form of a waist formed between the hollow filamentary constituent (A) and the non-hollow sinuous filamentary constituent (B).

The above-defined synthetic polymer hollow irregular multifilament yarn can be produced by the process of the present invention, which process comprises the steps of:

(A) extruding at least one fiber-forming polymer melt through a spinneret having a plurality of spinning orifices, in each of which orifices, (a) a polymer melt is extruded through a first orifice segment adequate for forming a hollow filament at a first extruding rate to form a hollow filamentary stream constituent; (b) a polymer melt is extruded through a second orifice segment adequate for forming a non-hollow filament at a second extruding rate higher than the first extruding rate to form a non-hollow filamentary stream constituent, the first orifice segment having a size larger than that of the second orifice segment; and (c) at least one polymer melt is extruded through a third orifice segment which is in the form of a thin slit and through which the first orifice segment is connected to the second orifice segment to form a complete orifice body, to form a middle filamentary stream constituent, whereby the non-hollow filamentary stream constituent is caused to sinuously travel in a wave form and is allowed to be connected to one side of the hollow filamentary stream constituent through the middle filamentary stream constituent to form a body of a hollow irregular filamentary stream;

(B) cool-solidifying the resultant hollow irregular filamentary stream; and (C) taking up the resultant hollow irregular filaments.

The afore-defined synthetic polymer hollow irregular multifilament yarn can be produced by using the spinneret of the present invention having a plurality of spinning orifices, each of which orifices is composed of a first orifice segment adequate for forming a hollow filament, a second orifice segment adequate for forming a non-hollow filament, and a third orifice segment in the form of a slit, through which the first orifice segment is connected to the second orifice segment to provide a complete orifice body, the size of the first orifice segment being larger than that of the second orifice segment.

BRIEF DESCRIPTION OF THE DRAWINGS

FIG. 2B is a cross-sectional profile of the individual filament indicated in FIG. 1 along the line $X_3$—$X_3$;

DESCRIPTION OF THE PREFERRED EMBODIMENTS

Figure 1:
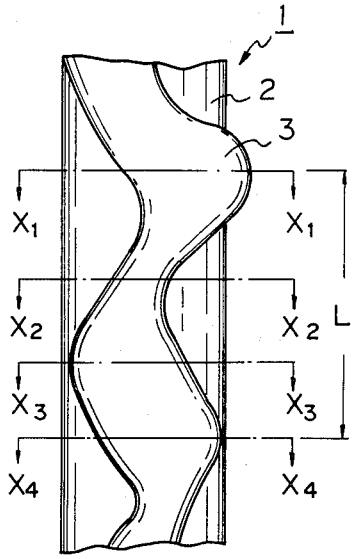
FIG. 1 is a side view of a hollow irregular individual filament in a multifilament yarn of the present invention.
Figure 2A:
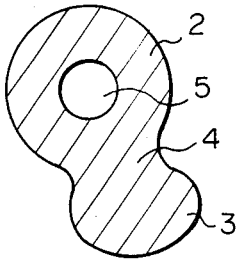
FIG. 2A is a cross-sectional profile of the individual filament indicated in FIG. 1 along the line $X_1$—$X_1$.
Figure 2B:
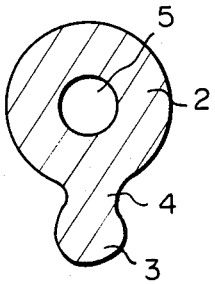
FIG. 2B is a cross-sectional profile of the individual filament indicated in FIG. 1 along the line $X_2$—$X_2$.
Figure 2C:
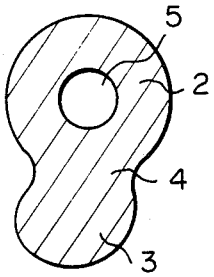
FIG. 2C is a cross-sectional profile of the individual filament indicated in FIG. 1 along the line $X_3$—$X_3$.
Figure 2D:
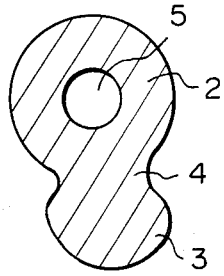
FIG. 2D is a cross-sectional profile of the individual filament indicated in FIG. 1 along the line $X_4$—$X_4$.

In accordance with the results of research made by the inventors of the present invention into the conventional irregular multifilament yarn as disclosed in U.S. Pat. Nos. 4,332,757 and 4,349,604, it was noted that the resultant bulky yarn converted from the conventional irregular multifilament yarn exhibits an unsatisfactory bulkiness, because the difference in shrinking property between the straight filamentary constituents and the sinuous filamentary constituents of the individual filaments in the multifilament yarn, and the difference in shrinking property between the individual filaments in the multifilament yarn, are not large enough to effectively convert the multifilament yarn to the bulky yarn.

Based on the above-mentioned findings, the inventors of the present invention discovered that hollow irregular individual filaments each comprising a hollow filamentary constituent extending along the longitudinal axis of the filament and having at least one hollow extending therealong, a non-hollow sinuous filamentary constituent sinuously extending in a wave form along the hollow filamentary constituent and having an average thickness smaller than that of the hollow filamentary constituent, and a middle filamentary constituent distortedly extending along the hollow filamentary constituent, while connecting therethrough the non-hollow sinuous filamentary constituent to one side of the hollow filamentary constituent to provide a body of hollow irregular multifilament having an uneven thickness varying along the longitudinal axis of the filament and having a cross-sectional profile in the form of a waist formed between the hollow filamentary constituent and the non-hollow sinuous filamentary constituent, are useful for providing a multifilament yarn capable of being converted to a bulky yarn having a high bulkiness. This is because in the above-mentioned hollow irregular filaments it is highly possible to enlarge the difference in shrinking property between the hollow filamentary constituent and the non-hollow sinuous filamentary constituent, and in addition, the above-mentioned hollow irregular filaments can easily provide a multifilament yarn wherein the individual filaments each exhibit a large difference in shrinking property.

Referring to FIGS. 1, and 2A to 2D a hollow-irregular individual filament 1 is composed of a hollow filamentary constituent 2 and a non-hollow sinuous filamentary constituent 3 connected to one side of the hollow filamentary constituent 2 through a middle filamentary constituent 4 in the form of waist formed therebetween. The hollow filamentary constituent 2 has a hollow 5 formed therewithin and extending along the longitudinal axis of the filament 1.

FIGS. 1 and 2A to 2D clearly show that the non-hollow sinuous filamentary constituent 3 sinuously extends in a wave or zigzag form on one side of and along the hollow filamentary constituent 2 and has an uneven thickness varying along the longitudinal axis of the filament 1. Therefore, the hollow irregular individual filament 1 has an uneven thickness and an uneven shrinking property, both varying along the longitudinal axis thereof.

Usually, the hollow filamentary constituent has a degree of orientation higher than that of the non-hollow sinuous filamentary constituent. Therefore, the shrinking property of the hollow filamentary constituent is higher than that of the non-hollow sinuous filamentary constituent.

Due to the double unevennesses in shrinking property between the hollow filamentary constituent and the non-hollow sinuous filamentary constituent and along the length of the filament, the hollow irregular filaments are highly effective for providing a multifilament yarn of the present invention capable of being converted to a high bulkiness yarn.

Figure 3:
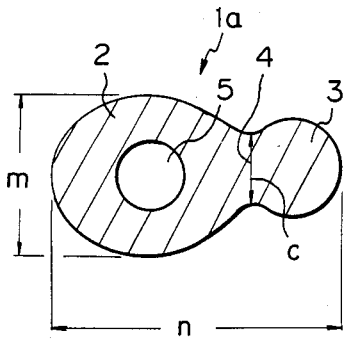
FIG. 3 is an explanatory cross-sectional profile of an individual filament of the hollow irregular multifilament yarn of the present invention.

Referring to FIG. 3, a cross-sectional profile 1*a* of an individual hollow irregular filament of the present invention has a major axis having a length n and a minor axis having a length m. The hollow filamentary constituent 2 has a larger size than that of the non-hollow sinuous filamentary constituent 3, and the middle filamentary constituent 4 is in the form of waist which is a narrowest portion of the cross-sectional profile 1*a*. The smallest thickness of the waist-shaped middle filamentary constituent 4 is indicated by a waist axis c. The cross-sectional profile of the hollow irregular individual filament of the present invention is always asymmetrical about the waist axis c thereof. Also, when the cross-sectional profile is divided into two portions by the waist axis c, the hollow 5 is always contained in the major portion of the cross-sectional profile.

In FIG. 3, the cross-sectional profile of the individual filament is in the form of a cocoon which is asymmetrical about a waist axis in the middle filamentary constituent. The cross-sectional profile of the hollow filamentary constituent 2 is in the form of an approximate round or an substantial oval, and the non-hollow filamentary constituent 3 has a substantially regular cross-sectional profile.

Figure 4:
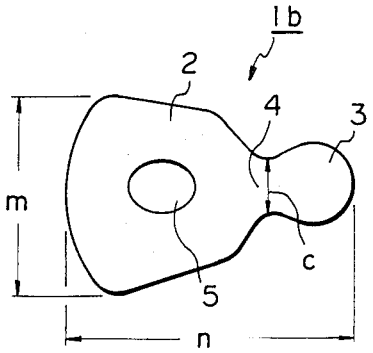
FIG. 4 is an explanatory cross-sectional profile of another individual filament of the hollow irregular multifilament yarn of the present invention.

However, the shape of the cross-sectional profile of the hollow filamentary constituent 2 is not limited to those mentioned above, as long as it has at least one hollow 5 therein. For example, in the cross-sectional profile 1*b* as indicated in FIG. 4, the hollow filamentary constituent 2 has an irregular cross-sectional profile which widens from an end thereof adjacent to the middle filamentary constituent 4 to the opposite end thereof in the form of an opened fan. This type of cross-sectional profile is effective for causing the resultant multifilament yarn products to exhibit a unique brilliance.

The non-hollow sinuous filamentary constituent may have any form of cross-sectional profile. However, the length of the outside contour line of the cross-sectional profile of the hollow filamentary constituent should be larger than that of the non-hollow filamentary constituent. In other words, the size of the non-hollow sinuous filamentary constituent should be smaller than that of the hollow filamentary constituent.

In the hollow irregular individual filaments, it is preferable that the area of the cross-section of the hollow corresponds to 2% to 30%, more preferably 10% to 15%, of the area of the cross-section of the hollow filamentary constituent. Also, it is preferable that the ratio of the entire area (Sg) of the cross-section of the hollow filamentary constituent to the area (Sh) of the cross-section of the non-hollow sinuous filamentary constituent, that is Sg/Sh, be in the range of from 1.2 to 3.0, more preferably, from 1.5 to 2.0. The areas Sg and Sh can be determined from a microscopic photograph of the cross-section of the hollow irregular individual filament.

In the hollow irregular individual filament of the present invention, it is important that the non-hollow sinuous filamentary constituent is bonded to one side of the hollow. filamentary constituent but does not wind itself around the hollow filamentary constituent. Therefore, the hollow irregular individual filament will have a large unevenness in thickness varying along the length thereof. This fact is illustrated in FIG. 5A which shows an unevenness in thickness of a hollow irregular multifilament yarn prepared in Example 1 which will be described hereinafter, in accordance with the present invention, determined by an Uster irregularity (evenness) tester, Model C.

Figure 5A:
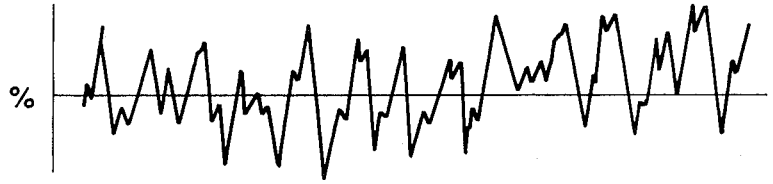
FIG. 5A is a graph showing an unevenness in thickness of a hollow irregular multifilament yarn of the present invention, determined by an Uster irregularity tester (trademark)
Figure 5B:
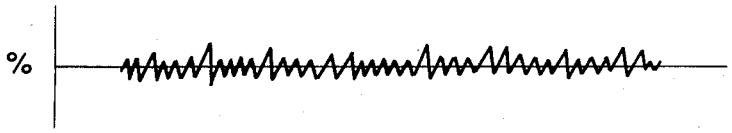
FIG. 5B is a graph showing an unevenness in thickness of a conventional thick-and-thin multifilament yarn, determined by the Uster irregularity tester.

FIG. 5B shows an unevenness in thickness of a conventional thick and thin yarn prepared in Comparative Example 1, which will be described hereinafter, determined by the Uster irregularity tester.

In view of FIGS. 5A and 5B, it is clear that the degree of the unevenness in thickness of the hollow irregular multifilament yarn of the present invention along the longitudinal axis thereof is significantly higher than that of the conventional filament.

Also, in view of FIG. 5A, the unevenness in thickness of the multifilament yarn of the present invention is similar to that of a multifilament yarn consisting of a plurality of types of individual filaments each having a different thickness.

FIGS. 1 and 2A to 2D show that the thickness of the filament 1 peaks at a location $X_1$—$X_1$, has a valley at a location $X_2$—$X_2$, and peaks at a location $X_3$—$X_3$. Usually, the length L between two peaks adjacent to each other is variable in a range of from 0.5 to 3 m.

Figure 6:
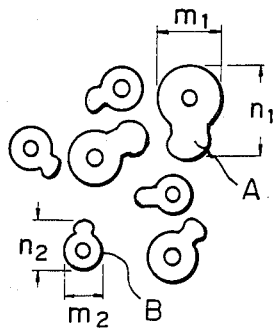
FIG. 6 shows an explanatory cross-sectional profile of a hollow irregular multifilament yarn of the present invention.

The variation in the thickness of the individual filaments may be periodical with a length L having a substantially fixed value. The periodicities in the variation of the thickness of the individual filaments may be different. In this type of multifilament yarn, when the multifilament yarn is cut and the resultant cross section is observed, it is found that, as indicated in FIG. 6, the thicknesses of the individual filaments are clearly different. This cross-sectional view of the multifilament yarn of the present invention is similar to that of conventional multifilament yarn consisting of two or more types of individual filaments each having a different thickness.

Referring to FIG. 6, in a plurality of individual filaments, a filament A has a largest cross-section area (thickness) and a filament B has a smallest cross-section area (thickness). The filament A has a largest length of major axis $n_1$ and a largest length of minor axis $m_1$ and the filament B has a smallest length of major axis $n_2$ and a smallest length of minor axis $m_2$.

Generally, where a multifilament yarn is composed of two or more types of individual filaments having different thickness, as indicated in FIG. 6, thick individual filaments having a large thickness or denier exhibit a higher heat shrinking property than that of fine individual filaments having a small thickness or denier. Therefore, the multifilament yarn can be converted to a bulky yarn by heat treating the yarn at an elevated temperature. In the bulky yarn, the fine filaments bulge from the thick filament toward the outside. Therefore, the bulky yarn exhibits a satisfactory rigidity and a soft touch.

When the hollow irregular multifilament yarn of the present invention satisfies the following relationship (I):

$$\frac{n_1 \times m_1}{n_2 \times m_2} \geqq 1.5 \qquad \text{(I)}$$

wherein in the major axes and the minor axes of the cross-sectional profiles of the individual filaments found in a cross-section of the multifilament yarn, $n_1$ represents a length of the largest major axis, $m_1$ represents a length of the largest minor axis, $n_2$ represents a length of the smallest major axis, and $m_2$ represents a length of the smallest minor axis, the resultant bulky yarn products from the multifilament yarn exhibit a very satisfactory rigidity and a very soft touch.

Figure 7A:
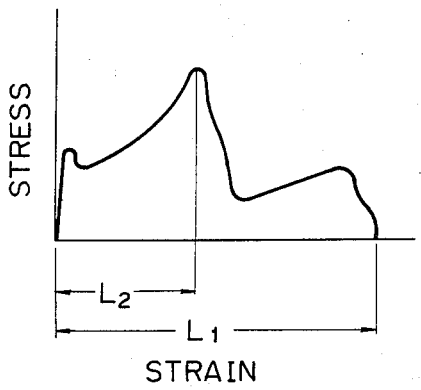
FIG. 7A is a graph showing a stress-strain curve of a hollow irregular multifilament yarn of the present invention.
Figure 7B:
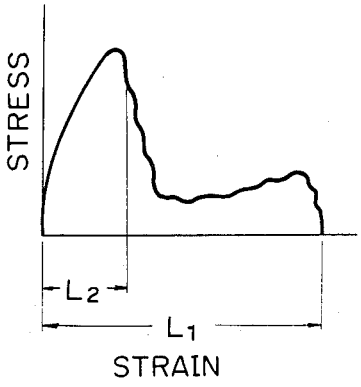
FIG. 7B is a graph showing a stress-strain curve of a hollow irregular multifilament yarn of the present invention which has been drawn and heat treated at an elevated temperature.

The hollow irregular multifilament yarn of the present invention is composed of a plurality of individual filaments each having a different heat shrinking property, and each individual filament having an uneven heat shrinking property varying along the longitudinal axis of the filament. Therefore, the multifilament yarn of the present invention exhibits a unique stress-strain relationship, as shown in FIGS. 7A and 7B. FIG. 7A shows a stress-strain curve of an undrawn multifilament yarn of the present invention. FIG. 7B shows a stress-strain curve of a drawn, heat set multifilament yarn of the present invention.

In each of FIGS. 7A and 7B, the multifilament yarn exhibits an ultimate elongation represented by $L_1$ at a break point thereof and an intermediate elongation represented by $L_2$ at a maximum stress point of the yarn. These two different elongations $L_1$ and $L_2$ can be found in a multifilament yarn composed of two or more types of individual filaments having significantly different heat shrinking properties. When a multifilament yarn is composed of a single type of individual filament or two or more types of individual filaments having slightly different heat shrinking properties, $L_1$ and $L_2$ in the stress strain curve of the yarn are overlapped.

Although the multifilament yarn of the present invention is composed of a single type of hollow irregular individual filament, the stress-strain curve of the multifilament yarn of the present invention is quite similar to that of the conventional multifilament yarn prepared by blending two or more types of individual filaments having different in heat shrinking properties.

Where the conventional multifilament yarn is composed of blended two or more different types of individual filaments, the larger the difference in the heat shrinking property between the different types of the individual filaments, the larger the difference between the values of $L_1$ and $L_2$, and, the larger the bulkiness of the resultant bulky yarn product.

When the hollow irregular multifilament yarn of the present invention satisfies the following relationship (II):

$$L_1 - L_2 \geqq 20\% \qquad \text{(II)}$$

wherein $L_1$ represents an ultimate elongation in percent of the yarn and $L_2$ represents an elongation in percent of the yarn at which elongation the yarn exhibits a maximum stress, the resultant bulky yarn product from the multifilament yarn exhibits a satisfactorily high bulkiness.

Even after a drawing and/or heat-setting procedure is applied, the resultant multifilament yarn of the present invention having enhanced mechanical properties can satisfy the above relationship (II).

Figure 8A:
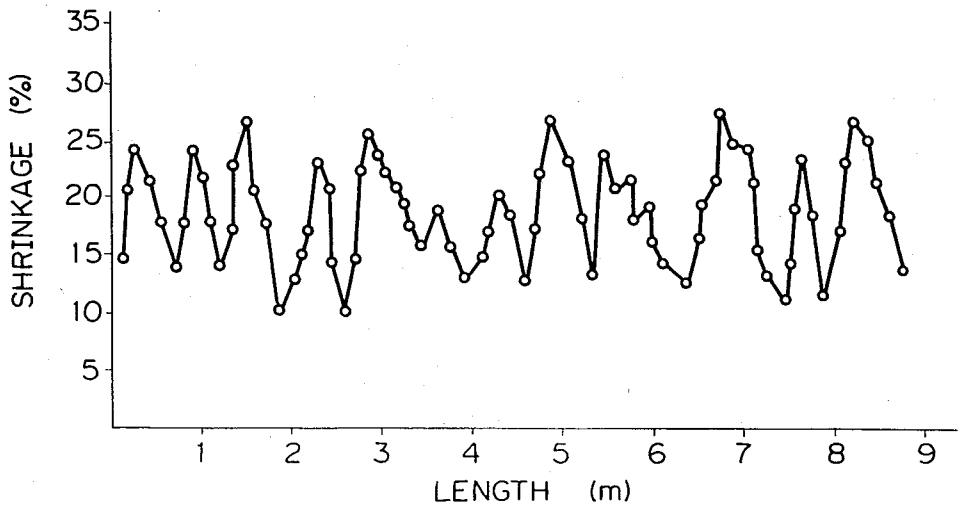
FIG. 8A is a graph showing a distribution of shrinkage of a hollow irregular multifilament yarn of the present invention which has interlaced, along the length thereof.
Figure 8B:
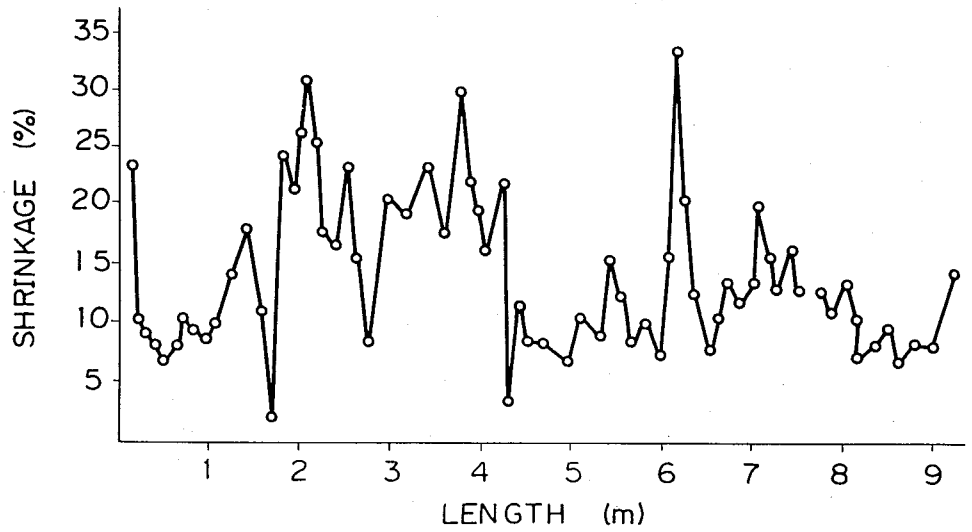
FIG. 8B is a graph showing a distribution of shrinkage of a hollow irregular multifilament yarn of the present invention which has not interlaced, along the length of thereof.

In the multifilament yarn of the present invention, it is preferable that the individual filaments be interlaced, preferably at an interlacing number of 10/m or more, more preferably, 15/m to 80/m. Also, referring to FIG. 1, it is preferable that the multifilament yarn composed of two or more types of individual filaments each being different in the length L between a peak in thickness and an adjacent peak in thickness of the filaments.

Where the individual filaments are interlaced and/or the individual filaments have different L values, the resultant multifilament yarn exhibits a distribution of heat shrinkages thereof along the length thereof as indicated in FIG. 8A. That is, FIG. 8A shows that high shrinking portions and low shrinking portions of the yarn are substantially evenly distributed along the length of the yarn. Therefore, when the yarn is subjected to a dyeing procedure and/or a heat-shrinking procedure, no unevenness in color or shrinkage is found in the resultant product.

Where no interlacing procedure is applied to the multifilament yarn and/or the individual filaments in the yarn have the same L value, the resultant multifilament yarn sometimes exhibits a distribution of heat shrinkages thereof along the length of the yarn as shown in FIG. 8B. In FIG. 8A, the high shrinking portions and the low shrinking portions of the yarn are unevenly distributed. Therefore, the resultant products sometimes exhibit uneven dyeing property and heat shrinking property varying along the length of the yarn.

In the preparation of FIGS. 8A and 8B, the measurement of heat shrinkage of the yarn was applied at every 10 cm of the yarn immersed in boiling water.

In the heat shrinkage of the yarn in boiling water, it is preferable that the difference between the largest shrinkage in the high shrinking portions and the smallest shrinkage in the low shrinking portions of the yarn be in the range of 35% or less, preferably, from 5% to 30%.

The individual filaments in the multifilament yarn of the present invention consist of at least one fiberforming synthetic polymeric resin. The individual filaments may consist of a single polymeric resin selected from the group consisting of polyester resins and polyamide resins. The polymeric resin is preferably selected from the polyester resins. That is, the polyester resin comprises at least one member selected from the group consisting of polyethylene terephthalate, polybutylene terephthalate, polyethylene terephthalateisophthalate copolymers and mixtures of at least two of the above-mentioned polymers. It is preferable that the polyester resin comprises at least one member selected from polyethylene terephthalate and polybutylene terephthalate.

The individual filaments may comprise two different polymeric resins. For example, in the individual filaments, the hollow filamentary constituents consist essentially of a first synthetic polymeric resin and the non-hollow sinuous filamentary constituents consist essentially of a second synthetic polymeric resin, which is different from and is preferably compatible with the first polymeric resin.

In the above-mentioned type of individual filaments, the first and second polymeric resins should be selected so that the resultant hollow filamentary constituents exhibit a higher heat shrinking property than that of the resultant non-hollow sinuous filamentary constituents.

Preferably, the first polymeric resin comprises a polyester resin, for example, a polyethylene terephthalate or polybutylene terephthalate, and the second polymeric resin comprises another polyester resin having a smaller intrinsic viscosity than that of the polyester resin for the first polymeric resin.

The middle filamentary constituents may consist of the same polymeric resin as that for either the hollow filamentary constituents or the non-hollow sinuous filamentary constituents. Otherwise, each middle filamentary constituents may be composed of a portion thereof adjacent to the hollow filamentary constituent and consisting of the same polymeric resin as that for the hollow filamentary constituent, and the remaining portion thereof adjacent to the non-hollow sinuous filamentary constituent and consisting of the same polymeric resin as that for the non-hollow sinuous filamentary constituent.

When the hollow irregular individual filaments have a large denier of 3 or more, it is preferable that the hollow filamentary constituents consist of a first polymer resin which is different from and is adhesive to a second polymer resin from which the non-hollow filamentary constituent are formed and which first polymer resin causes the hollow filamentary constituents to exhibit a significantly higher heat shrinking force than the non-hollow filamentary constituents at an elevated temperature. Also, it is preferable that when the first and second polymer resins are separately converted to multifilament yarns, respectively, under the same melt-spinning conditions the shrinkage of the resultant multifilament yarn from the first polymer resin in boiling water is at least 1.5% above that from the second polymer resin.

For example, the first (high shrinking) polymer resin consists of a polyester resin having a low intrinsic viscosity and the second (low shrinking) polymer resin consists of another polyester resin having a high intrinsic viscosity.

When a polyethylene terephthalate containing at least 85 molar % of recurring units consisting of ethylene terephthalate is used as a second (low shrinking) polymer resin for the non-hollow filamentary constituents, it is preferable that the first (high shrinking) polyester resin for the hollow filamentary constituents preferable consists of at least one member selected from copolyesters, for example, ethylene terephthalateisophthalate copolymers and ethylene terephthalatehydroxybenzoate copolymers, mixtures of polyesters with polymethylacrylate and/or polysulfons, and polybutylene terephthalate. When the above-mentioned polyethylene terephthalate is used as a first (high shrinking) polymer resin for the hollow filamentary constituents, it is preferable that the non-hollow filamentary constituents consist of a low shrinking copolyester such as an ethylene terephthalate-sulfonic acid compound copolyester.

Otherwise, the hollow filamentary constituents consist of a nylon 66 resin and the non-hollow filamentary constituents consist of a nylon 6 resin, which is highly adhesive to the nylon 66.

The hollow irregular multifilament yarn of the present invention is produced by the process comprising the steps of (A) extruding at least one fiber-forming polymer salt through a spinneret having a plurality of spinning orifices adequate for forming hollow irregular filamentary streams, (B) cool-solidifying the resultant hollow irregular filamentary stream of the polymer melt, and (C) taking up the resultant hollow irregular filaments.

In each of the orifices, (a) a polymer melt is extruded through a first orifice segment adequate for forming a hollow filament at a first extruding rate to form a hollow filamentary stream constituent; a polymer melt is extruded through a second orifice segment adequate for forming a non-hollow filament at a second extruding rate larger than the first extruding rate to form a non-hollow filamentary stream constituent, the first orifice segment having a size larger than that of the second orifice segment; and (c) at least one polymer melt is extruded through a third orifice segment which is in the form of a thin slit and through which the first orifice segment is connected to the second orifice segment to form a complete body of spinning orifice, to form a middle filamentary stream constituent, whereby the non-hollow filamentary stream constituent is caused to sinuously travel in a wave form and is allowed to be connected to one side of the hollow filamentary stream constituent through the middle filamentary stream constituent to form a body of a hollow irregular filamentary stream.

The above-mentioned process of the present invention is carried out by using the spinneret of the present invention, which has a plurality of spinning orifices each being composed of:

(i) a first orifice segment adequate for forming a hollow filament;

(ii) a second orifice segment adequate for forming a non-hollow filament; and (iii) a third orifice segment in the form of a slit located between the first and second orifice segments. The first orifice segment is connected to through the third orifice segment the second orifice segment to provide a complete orifice body. The size of the first orifice segment is larger than that of the second orifice segment. In other words, the total length of the contour line (or lines) of the cross-sectional profile of the first orifice segment is larger than that of the second orifice segment.

Figure 9A:
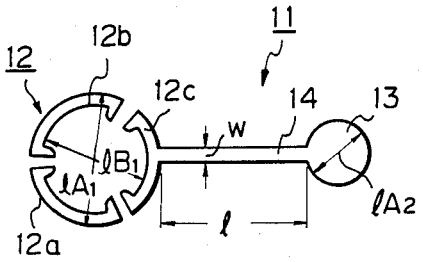
FIG. 9A is an explanatory cross-sectional view of an extrusion opening of a spinning orifice usable for the present invention.

Referring to FIG. 9A showing a cross-section of a spinning orifice for the present invention, the orifice 11 is composed of a first orifice segment 12 adequate for providing a hollow filament, a second orifice segment 13 adequate for forming a non-hollow filament, and a third orifice segment 14 in the form of a slit located between and connected to the first and second orifice segments 12 and 13.

The first orifice segment 12 is composed of two or more slits arranged along a closed channel pattern, the ends of the slits being spaced apart at least one of the slits being connected to the third orifice segment. For example, the first orifice segment 12 shown in FIG. 9A is composed of three arc-shaped slits 12*a*, 12*b* and 12*c* arranged along a substantial circular (ring) pattern, the ends of the arc-shaped slits 12*a*, 12*b* and 12*c* being spaced apart.

Figure 9B:
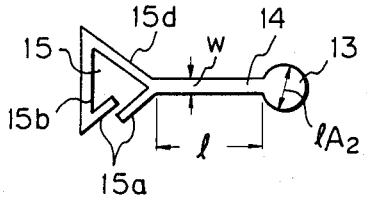
FIG. 9B is an explanatory cross-sectional view of an extrusion opening of another spinning orifice usable for the present invention.

Referring to FIG. 9B, the first orifice segment 15 is composed of two slits 15*a* and 15*b* arranged along a triangular pattern. The small slit 15*a* extends from an end of the third orifice segment 14 and the large slit 15*b* extends from the same end of the third orifice segment 14 as mentioned above, at an angle, for example, 60 degrees, from the small segment 15*a* and bends along a triangle pattern, as shown in FIG. 9B. The ends of the small and large slits 15*a* and 15*b* are spaced apart.

In FIGS. 9A and 9B third orifice segment 14 is in the form of a straight slit and has a length l and a width w. The third orifice segment may be in the form of an arc-shaped or hook-shaped slit.

In the orifices shown in FIGS. 9A and 9B, the second orifice segment 13 has a cross-sectional profile in the regular form of a round. However, the cross-sectional profile of the second orifice segment may be in any irregular forms, for example, triangular rectangular, hexagonal or Y-shaped, as long as it can form a non-hollow filament. In FIG. 9A, the first orifice segment 12 has an outer diameter lA1 and an inner diameter lB1.

The second orifice segment 13 has a round cross-sectional profile having a diameter lA2.

The diameter lA1 is larger than the diameter lA2 and therefore, the area defined by the diameter lA1 is larger than that defined by the diameter lA2.

Also, the total length of the contour lines of the arc-shaped slits 12*a*, 12*b* and 12*c* in the first orifice segment 12 is larger than that of the second orifice segment 13.

In FIG. 9B, the area of a triangle defined by the slits 15*a* and 15*b* in the first orifice segment 15 is larger than the cross-sectional area of the second orifice segment 13. Also, the total length of the contour lines of the lists 15*a* and 15*b* is larger than that of the second orifice segment 13.

Accordingly, when a polymer melt is extruded through a spinning orifice under a predetermined pressure, the frictional resistance of the first orifice segment to the flow of the polymer melt is larger than that of the second orifice segment. This feature causes the pressure loss of the polymer melt in the first orifice segment to be larger than in the second orifice segment and, therefore, the extending (flow) rate of the polymer melt flowing through the first orifice segment to be smaller than that flowing through the second orifice segment. This phenomenon causes the non-hollow filamentary stream constituent extruded through the second orifice segment to sinuously travel along one side of the hollow filamentary stream constituents extruded through the first orifice segment.

When a draft force is applied to the extruded hollow irregular filamentary stream, the major portion of the draft force is absorbed by the hollow filamentary constituent. That is, the draft ratio applied to the hollow filamentary constituent is larger than that applied to the non-hollow sinuous filamentary constituent. This phenomenon results in a higher degree of orientation of the resultant hollow filamentary constituent than that of the non-hollow sinuous filamentary constituent. Therefore, the resultant hollow filamentary constituent exhibits a larger heat shrinking property than that of the resultant non-hollow sinuous filamentary constituent.

The hollow filament-forming orifice segment (the first orifice segment) is effective for imparting a larger frictional resistance to the flow of the polymer melt flowing therethrough than that flowing through the non-hollow (regular) filament-forming orifice segment (the second orifice segment).

The difference in extruding rate of the polymer rate between the hollow filamentary stream constituent and the non-hollow filamentary stream constituent can be controlled by adjusting the shape and size of the first orifice segment in relation to those of the second orifice segment. If the area defined by outer contour lines of the slits in the first orifice segment is equal or close to that of the second orifice segment, sometimes the extruding rate of the non-hollow filamentary stream constituent extruded through the second orifice segment is excessively large in relation to that of the hollow filamentary stream constituent extruded through the first orifice segment, and therefore, the extruding operation becomes unstable.

A portion of the polymer melt may be extruded through the second orifice segment under a higher pressure than that applied to another portion of the polymer melt extruded through the first orifice segment, so as to result in a higher extruding rate of the resultant non-hollow sinuous filamentary stream constituent than that of the hollow filamentary stream constituent.

The middle filamentary stream constituent extruded through the third orifice segment travels together with both the hollow filamentary constituent and the non-hollow sinuous filamentary constituent, and shrinks laterally due to the surface tension of the polymer melt so as to pull the non-hollow sinuous filamentary stream constituent nearer toward one side of the hollow filamentary stream constituent and to connect them therethrough into a body of the filament. The laterally shrunk middle filamentary stream constituent serves to form a waist between the hollow and non-hollow filamentary stream constituent. Therefore, the non-hollow sinuous filamentary stream constituent is never separated from and never wound around the hollow filamentary stream constituent. The size and shape of the waist in the resultant filament can be controlled by adjusting the length l and the width w of the third orifice segment.

Also, referring to FIG. 1 and FIGS. 9A and 9B, the value of L in FIG. 1, that is, the length between two adjacent peaks in thickness of the filament, can be varied by varying the length l of the middle orifice segment shown in FIGS. 9A and 9B.

In the spinneret of the present invention, the number, arrangement, and cross-sectional profile of the spinning orifices are variable. That is, the first orifice segments for forming the hollow filamentary constituents may have any irregular cross-sectional profiles, for example, those as disclosed in British Pat. No. 853,062, preferably, a triangle cross-sectional profile as indicated in FIG. 9B. The first orifice segment as indicated in FIG. 9B is effective for forming opened fan-shaped hollow irregular filaments as shown in FIG. 4. This type of hollow irregular filaments are effective for producing hollow irregular multifilament bulky yarn products having a unique brilliance.

When the spinning orifices as shown in FIG. 9A are used, the resultant hollow irregular filaments have a cocoon-shaped cross-sectional profile as shown in FIG. 3. The spinning orifices shown in FIG. 9A can be produced easily, and therefore, are preferable for industrial use.

In the spinning orifice shown in FIG. 9A, it is preferable that the following relationships be satisfied.

$$1.5 \leqq S_1/S_2 \leqq 15$$

$$0.04 \leqq (lA_1 - lB_1)/2 \leqq 0.30$$

$$0.10 \leqq lA_2 < lB_1 < lA_1 \leqq 1.5$$

$$0.05 \leqq l \leqq 1.30$$

and $$0.03 \leqq w < lA_2 \leqq 1.0$$

In the above relationships, $S_1$ represents the sum of areas of the cross-sections of the slits in the first orifice segment, $S_2$ represents the area of the cross-sections of the second orifice segment, and $lA_1$,$lB_1$, $lA_2$, l, and w are in units of mm.

In the spinneret of the present invention, the spinning orifices have a different value of the ratio $S_1/S_2$ and/or the length l. When this type of spinneret is used, the resultant hollow irregular multifilament yarn exhibits similar properties to those of conventional multifilament yarns consisting of two or more types of individual filaments each having a different thickness and shrinking property.

In the extruding step of the process of the present invention, it is preferable that the ratio ($V_1/V_2$) of the flow velocity ($V_1$) of the hollow filamentary stream constituent through the first orifice segment to the flow velocity ($V_2$) of the non-hollow sinuous filamentary stream constituent through the second orifice segment be in the range of from 1/1.5 to 1/7, more preferably, from 1/2.3 to 1/3.4. Also, it is preferable that the ratio of the extruding rate of the hollow filamentary stream constituent to that of the non-hollow sinuous filamentary stream constituent be in the range of from 3/1 to 1.05/1, more preferably from 1.5/1 to 1.1/1.

The above-mentioned ranges of the flow velocity and extruding rate are effective for stabilizing the extruding procedure for the hollow irregular multifilament yarn.

In the process of the present invention, the extruded hollow irregular filamentary streams are solidified by cooling, and the resultant hollow irregular filaments are taken up at a predetermined speed.

The solidifying procedure is carried out by bringing a cooling air into contact with the extruded filamentary streams.

The solidified filaments are taken up or are heat-set at an elevated temperature and are then taken up. Otherwise, the solidified filaments are drawn, are heat set, and then taken up.

The taking up procedure is carried out preferably at a taking up speed of 2,500 m/min or more, more preferably, 4,000 m/min or more, still more preferably from 4,500 to 5,500 m/min.

When the multifilament yarn is taken up at a speed of 4,000 m/min or more, the resultant multifilament yarn can be subjected to practical use without applying a drawing procedure thereto. The multifilament yarn taken up at the high speed of 4,000 m/min or more exhibits a satisfactory capability of being converted to a bulky yarn.

Also, it is preferable that the draft ratio applied to the hollow filamentary stream constituent extruded through the first orifice segment be 500 or more, more preferably, from 800 to 3000, at the taking up speed of 2,500 m/min or more.

Furthermore, it is preferable that the ratio in draft ratio of the hollow filamentary stream constituent to the non-hollow sinuous filamentary constituent be in the range of from 7/1 to 1.5/1.

In the process of the present invention, the hollow filamentary stream constituent extruded through the first orifice segment at a low extruding rate is connected to the non-hollow sinuous filamentary stream constituent extruded through the second orifice segment at a high extruding rate, through the middle filamentary stream constituent extruded through the third orifice segment. The extruding rate of the middle filamentary stream constituent is controlled by adjusting the thickness w and the length $lA_2$ thereof, so that the middle filamentary stream constituent can accompany both the hollow and non-hollow filamentary stream constituents and can connect them therethrough into a body of a filamentary stream.

Figure 10A:
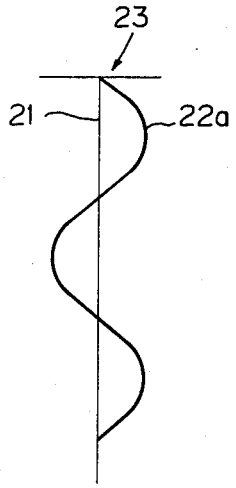
FIG. 10A to 10D respectively show sinuous traveling paths of non-hollow sinuous filamentary stream constituents of a polymer melt in relation to straight traveling paths of hollow filamentary stream constituents.
Figure 10B:
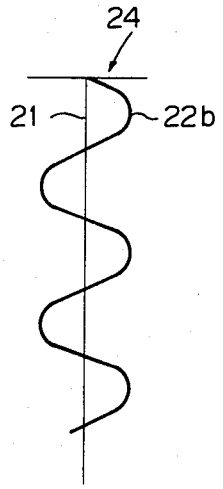
Figure 10C:
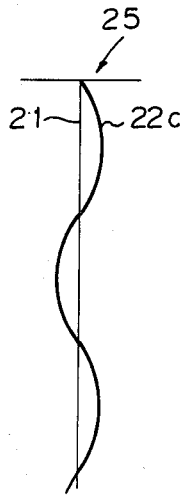

Referring to FIG. 10A to 10C, the hollow filamentary stream constituents 21 extruded through the first orifice segments 21 travel downward along the straight path. However, the non-hollow sinuous filamentary stream constituents 22*a* to 22*d* extruded through the second orifice segments travel along various sinuous paths.

Referring to FIGS. 10A and 10B, non-hollow sinuous filamentary stream constituents 22*a* and 22*b* are respectively extruded through spinning orifices 23 and 24 which are different in that the length l of the third orifice segment in the orifice 24 is smaller than that in the orifice 23. FIGS. 10A and 10B show that the shortening of the length l of the third orifice segment results in a shortened periodicity (wave length) of the sinuations of the sinuous traveling path of the non-hollow filamentary stream constituent. Also, enlarging the length l will result in an enlarged periodicity of the sinuation of the sinuous traveling path of the non-hollow filamentary stream constituent 22*b*.

Referring to FIGS. 10A and 10C, the orifice 25 has a smaller ratio $S_1/S_2$ than that of the orifice 23. The smaller ratio $S_1/S_2$ results in a larger periodicity and smaller amplitude of the sinuation of the sinuous path of the non-hollow filamentary stream constituent 22*c* than those of the non-hollow filamentary stream constituent 22*a*.

Figure 10D:
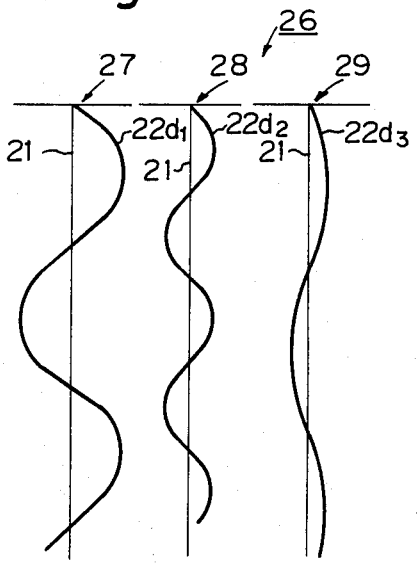

Referring to FIG. 10D, a spinneret 26 is provided with three types of spinning orifices 27, 28 and 29 which are different in the length l of the third orifice segment and in the ratio $S_1/S_2$. Therefore, the sinuous traveling path of the non-hollow filamentary stream constituents $22d_1$, $22d_2$, and $22d_3$ extruded respectively through the orifices 27, 28, and 29 are different not only in the periodicity of the sinuations, but also, in the amplitude of the sinuations. Therefore, the resultant multifilament yarn is composed of three types of individual filaments having different thickness and periodicity of the varying of the thickness.

Figure 11:
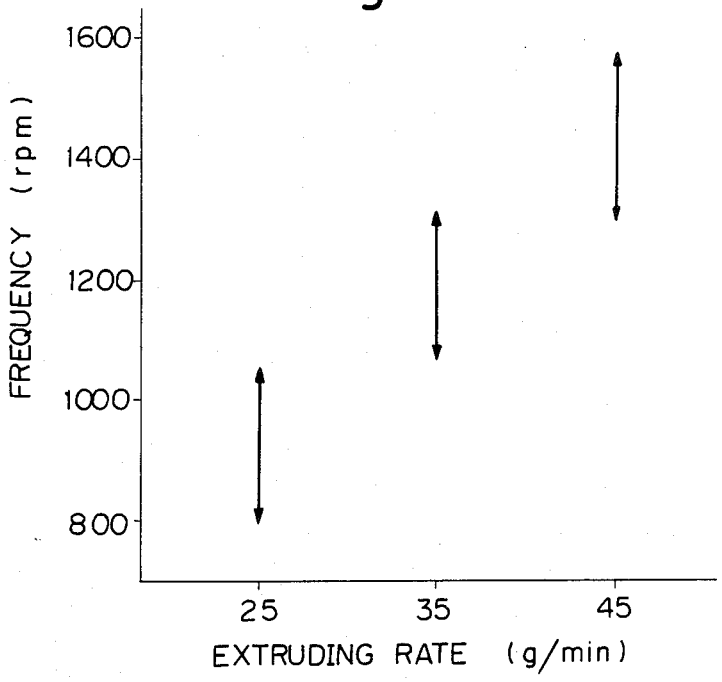
FIG. 11 is a graph showing a distribution of the frequency of sinuations of non-hollow sinuous filamentary stream constituents of a polymer melt extruded through a spinneret having 36 spinning orifices adequate for producing the hollow irregular multifilament yarn of the present invention, in the orifices, the lengths of the third orifice segments being different from each other.

FIG. 11 shows a distribution in frequency of sinuations of non-hollow sinuous filamentary stream constituents of a polymer melt extruded through a spinneret having 36 spinning orifices different in the length l of the third orifice segment therein, determined by a stroboscope, when the polymer melt was extruded at three different extruding rates.

FIG. 11 indicates that in each extruding rate of the polymer melt, the frequency of sinuations of the non-hollow sinuous filamentary stream constituents varies in the wide range of about 350 rpm. However, if the polymer melt is extruded through a spinneret having 36 spinning orifices which have the same length of the third orifice segment, the distribution of the frequency of the sinuations of the non-hollow filamentary stream constituents is within a narrow range of about 50 rpm. Therefore, the resultant multifilament yarn is composed of the individual filaments which have substantially the same thickness and periodicity of varying the thickness.

Figure 12:
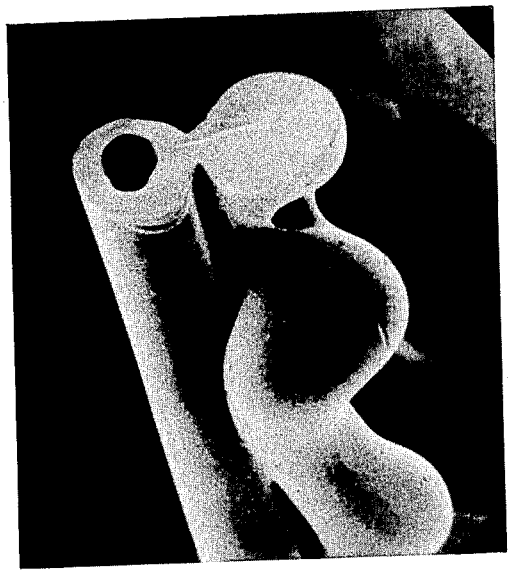
FIG. 12 is an electron microscopic photograph of a hollow irregular filament which has been prepared by extruding a polymer melt through the spinning orifice as indicated in FIG. 9A in accordance with the process of the present invention, and by cool-solidifying the extruded hollow irregular filamentary stream, just below the spinning orifice.

FIG. 12 is an electron microscopic photograph of a hollow irregular filament prepared by extruding a polyethylene terephthalate melt through the spinning orifice as shown in FIG. 9A, and by cool-solidifying the extruded filamentary stream just below the spinning orifice.

FIG. 12 shows that the hollow filamentary constituent is in the form of a tube having a fixed diameter and the non-hollow filamentary constituent meanders in the form of an S while varying the cross-sectional area thereof. FIG. 12 also shows that the non-hollow sinuous filamentary constituent is bonded to one side of the hollow filamentary constituent but is never coiled around the hollow filamentary constituent.

The hollow irregular filament shown in FIG. 12 has not yet been drafted. Therefore, the cross-sectional profile of the filament shown in FIG. 12 is not quite the same as that of the drafted filament shown in FIGS. 2A to 2D.

The solidified hollow multifilament yarn of the present invention is preferably subjected to an interlacing procedure so as to interlace the individual filaments, before the taking-up step.

The interlacing procedure is effective for making even the distribution of high shrinking portions and low shrinking portions of the individual filaments in the yarn.

The interlacing procedure may be effected by any known methods, for example, electric opening method, taslan nozzle method, and interlace nozzle method. A preferable interlacing method is the interlace nozzle method which has a superior productivity and operating efficiency. The interlace nozzles usable for the present invention are disclosed, for example, in U.S. Pat. Nos. 3,069,836, 3,083,523, and 3,110,151.

In the interlacing procedure, the number of interlacing to be applied to the multifilament yarn is preferably 10 interlacings/m or more, more preferably, in the range of from 15 to 80 interlacings/m. The above-mentioned number of interlacings is effective for uniformly distributing the high shrinking portions and low shrinking portions of the individual filaments in the yarn, and for obtaining final products having a superior touch.

The present invention will be illustrated in detail by the following non-limiting examples and comparative examples.

In the examples, the cross-sectional dimensions, elongation, shrinkage, the number of interlacings, and touch of the resultant hollow irregular individual filaments or multifilament yarns were determined by the following methods.

(1) Cross-sectional dimensions ($n_1$, $n_2$, $m_1$, $m_2$, and Sg/Sh) of individual filaments in multifilament yarn.

A microscopic photograph of a cross-section of a multifilament was taken at a magnification of 560. In the photograph, a length $n_1$ of a major axis and a length $m_1$ of a minor axis of a cross-section of a thickest individual filament and a length $n_2$ of a major axis and a length $m_1$ of a minor axis of a cross-section of a thinnest individual filament were measured.

Also, the average entire cross-sectional area (Sg) of the hollow filamentary constituents and the average cross-sectional area (Sh) of the non-hollow filamentary constituents in the photograph were measured. The area Sg included the cross-sectional area of the hollow in the corresponding hollow filamentary constituent.

(2) Elongation of multifilament yarn

A stress-strain curve of a specimen of a multifilament yarn was determined by using a tensile tester at a temperature of 25° C., at a relative humidity of 60%, at a testing length of specimen of 10 cm, and at a tensile testing speed of 200 mm/min. An elongation ($L_2$) of the specimen at which the specimen exhibited a maximum tensile stress and an ultimate elongation ($L_1$) of the specimen at which the specimen was broken were determined from the stress-strain curve.

(3) Average shrinking property of multifilament yarn (a) Wet shrinkage in boiling water A multifilament yarn in the form of a hank was immersed in boiling water for 30 minutes under no tension. The shrinkage of the yarn was determined in accordance with the following equation:

$$\text{Wet shrinkage (\%)} = \frac{(l_0 - l_\omega)}{l_0} \times 100$$

wherein $l_0$ represents an original length of the hank and $l_1$ represents a length of the hank after being treated with boiling water.

(b) Dry shrinkage at 120° C.

A multifilament yarn in the form of a hank was dry heated at a temperature of 120° C. for 5 minutes under a load of 2.5 mg/d. The dry shrinkage of the yarn was determined in accordance with the following equation:

$$\text{Dry shrinkage (\%)} = \frac{(l_0 - l_2)}{l_0} \times 100$$

wherein $l_0$ represents an original length of the hank and $l_2$ represents a length of the hank after dry heating.

(4) Number of interlacings

A specimen of a multifilament yarn having a length of 70 cm was floated in water for 30 seconds and then the number of interlacings of the individual filaments within a testing length of 25 cm was counted by unaided visual observation. The above-mentioned operations were repeated four times on four different specimens.

The average value of the counted numbers of interlacings was converted to a value per m of the yarn.

(5) Touch (Bulkiness and spun yarn-like hand)

A multifilament yarn was knitted into a tubular knitted fabric, was dyed in accordance with an ordinary dyeing process, was washed with water, was dried, and was finally heat set at a temperature of 180° C. for one minute. The intensities of bulky touch and spun yarn-like hand of the resultant knitted fabric were evaluated by way of hand-touch and unaided visual observation.

EXAMPLE 1

A polyethylene terephthalate resin containing 0.3% by weight of a delustering agent consisting of titanium dioxide and having an intrinsic viscosity [η] of 0.64 was melted at 300° C. and the melt was extruded from a spinneret having 36 spinning orifices as shown in FIG. 9A at an extruding rate of 37.5 g/min. The dimensions $lA_1$, $lB_1$, $lB_2$, w, and l of the orifices are shown in Table 1. Also, the ratio $S_1/S_2$ of the orifices is shown in Table 1.

TABLE 1

| First orifice segment | | | Second orifice segment | Third orifice segment | | Ratio |
|---|---|---|---|---|---|---|
| Outer diameter $A_1$ | Inner diameter $B_1$ | Width of arc-shaped slits $\frac{(lA_1 - lB_1)}{2}$ | Diameter $lA_2$ | Width (w) | Length (l) | $S_1/S_2$ (*) |
| 1.00 mm | 0.80 mm | 0.10 mm | 0.30 mm | 0.05 mm | 0.70 mm | 4.0 |

Note:
(*)$_\omega$ $S_\omega = \pi\{(lA_\omega/2)^2 - (lB_\omega/2)^2\}$
$S_2 = \pi(lA_2/2)^2$ In the extruding procedure, the ratio in extruding rate and the ratio in flow speed of the hollow filamentary stream constituent to the non-hollow filamentary stream constituent were 1.2/1 and 1/3.3, respectively.

The non-hollow filamentary stream constituent sinuously traveled in a wave-form and was connected to one side of the hollow filamentary stream constituent through a middle filamentary stream constituent.

The extruded hollow irregular filamentary streams of the polymer melt were cool-solidified by blowing cooling air at a temperature of 26° C., at a relative humidity of 60%, and at a linear flow speed of 30 cm/sec toward the filamentary streams.

The resultant solidified multifilament yarn was oiled in a usual manner and was then wound at a speed of 4,500 m/min. The resultant yarn had a yarn count of 75 deniers/36 filaments.

The individual filaments in the resultant yarn had a similar cross-sectional profile to those shown in FIGS. 2A to 2D. The cross-sectional area of the hollow in the hollow filamentary constituent corresponded to 12% of the entire cross-sectional area of the hollow filamentary constituent. Also, the yarn exhibited a large Uster unevenness in thickness, as shown in FIG. 5A.

The properties and dimensions of the resultant multifilament yarn are shown in Table 2.

TABLE 2

| Individual filament | | Multifilament yarn | | | | | |
|---|---|---|---|---|---|---|---|
| | | Tensile strength | Wet shrinkage in boiling water | Dry shrinkage at 120° C. | Stress-strain curve | | |
| $\frac{n_1 \times m_1}{n_2 \times m_2}$ | Sg/Sh | (g/d) | (%) | (%) | $L_1$ (%) | $L_2$ (%) | $L_1 - L_2$ (%) |
| 2.5 | 1.4 to 1.6 | 2.7 | 34 | 30 | 240 | 75 | 165 |

As shown in Table 2, the resultant multifilament exhibited a low $L_2$ of 75%. Therefore, the multifilament yarn could be subjected to practical use without applying a drawing procedure and/or heat setting procedure thereto.

The multifilament yarn was knitted into a tubular knitted fabric and was dyed with a disperse dye in the following manner.

| Dyeing liquid: | |
|---|---|
| Dye: | Polyester Eastman Blue (Trademark) 4% owf |
| Additive: | Monogen (Trademark) 0.5 g/l |
| Liquor ratio: | 1/100 |
| Temperature: | 100° C. |

-continued

| | |
|---|---|
| Time: | 60 minutes |

The dyed fabric was washed with water, was dried and finally, was heat set at a temperature of 180° C. for one minute.

The resultant dyed fabric had an even brilliant color, a satisfactory rigidity to hand, and an excellent bulkiness similar to that of a knitted fabric made of a woolly textured yarn.

EXAMPLES 2 to 5

In Example 2, the same procedures as those described in Example 1 were carried out except that the taking up speed was 3,000 m/min, the extruding rate was 35 g/min, and the resultant undrawn hollow irregular multifilament yarn was drawn-heat set by using a slit heater under the following conditions.

| Draw-heat setting conditions | |
|---|---|
| Preheating temperature: | 80° C. |
| Heat setting temperature: (Slit heater temperature) | 180° C. |
| Draw ratio: | 1.4 |
| Withdrawing speed: | 500 m/min |

The resultant multifilament yarn had a yarn count of 75 deniers/36 filaments.

The properties and dimensions of the resultant yarn are shown in Table 3.

TABLE 3

| Individual filament | | | Multifilament yarn | | | | | |
|---|---|---|---|---|---|---|---|---|
| Cross-sectional area of hollow (%) | $\frac{n_1 \times m_1}{n_2 \times m_2}$ | Sg/Sh | Tensile strength (g/d) | Wet shrinkage in boiling water (%) | Dry shrinkage at 120° C. (%) | Stress-strain curve $L_1$ (%) | $L_2$ (%) | $L_1 - L_2$ (%) |
| 11 | 2.6 | 1.4 to 1.6 | 2.7 | 18 | 20 | 110 | 30 | 80 |

As shown in Table 3, the multifilament yarn which was drawn and heat set, exhibited a still high shrinking property.

The multifilament yarn was converted to a dyed tubular knitted fabric in the same manner as that described in Example 1. The fabric exhibited an even brilliant color and the same bulky touch as that of a woolly textured yarn fabric.

In each of Examples 3 to 5, the same procedures as those described in Example 2 were carried out except that the draw-heat setting procedure was carried out at the temperature indicated in Table 4.

The wet shrinkage of the resultant multifilament yarn in boiling water and bulkiness of the resultant knitted fabric are shown in Table 4.

TABLE 4

| Example No. | Draw-heat setting temperature (°C.) | Wet shrinkage in boiling water (%) | Bulkiness of knitted fabric |
|---|---|---|---|
| 2 | 180 | 18 | Standard |
| 3 | 200 | 15 | Similar to standard |
| 4 | 220 | 12 | Slightly poorer than standard and satisfactory |
| 5 | 240 | 8 | Little poorer than standard and still satisfactory |

Table 4 shows that even when the multifilament yarn was drawn-heat set at a very elevated temperature, to cause the heat shrinking property thereof in boiling water to decrease to less than 15%, the resultant multifilament yarn fabric exhibited a satisfactory bulky touch. This feature was derived from the specific structure of the individual filaments in the multifilament yarn. That is, the multifilament yarn showed a significant difference in heat shrinking property between the individual filaments and between high shrinking portions and low shrinking portions of the individual filaments.

Comparative Example 1

The same polyethylene terephthalate resin as that described in Example 1 was melted at a temperature of 300° C. and the melt was extruded through a spinneret having 36 spinning orifices, as described in U.S. Pat. Nos. 4,332,757 and 4,349,604, at an extruding rate of 37.5 g/min.

Each spinning orifice has a pair of a first capillary having a diameter of 0.15 mm and a land length of 0.30 mm and a second capillary having a diameter of 0.27 mm and a land length of 1.3 mm. The longitudinal axes of the first and second capillaries are inclined from the vertical and cross each other at an angle of 5 degrees at a location just below the spinneret surface.

The ratios in flow velocity and in extruding rate of the second filamentary stream from the second to the first filamentary stream from the first capillary was 1.9:1 or less and 1.6:1 or less, respectively.

The first filamentary stream traveled so as to coil around the second filamentary stream which traveled straight downward, and was bonded to the second filamentary stream, to form a body of a composite filamentary stream.

The resultant composite filamentary streams were cool-solidified and the resultant undrawn multifilament was wound at a speed of 3,000 m/min. The undrawn multifilament was drawn-heat set in the same manner as that described in Example 2 at a temperature of 180° C.

The properties and dimensions of the yarn were as shown in Table 5.

TABLE 5

| Individual filament $n_1 \times m_1$ / $n_2 \times m_2$ | Multifilament yarn: Tensile strength (g/d) | Wet shrinkage in boiling water (%) | Dry shrinkage at 120° C. (%) | Stress-strain curve: $L_1$ (%) | $L_2$ (%) | $L_1 - L_2$ (%) |
|---|---|---|---|---|---|---|
| 2.2 | 4.2 | 8 | 9 | 35 | 30 | 5 |

The individual filaments in the drawn-heat set yarn had a flat cross-sectional profile but did not have a hollow. Also, the unevenness in thickness of the filaments was small.

The multifilament yarn was converted to a dyed knitted fabric in the same manner as that described in Example 1. The resultant fabric exhibited a poor bulkiness and a paper-like touch similar to that of a knitted fabric produced from a flat yarn. That is, the multifilament yarn had a small difference in shrinking property between the individual filaments and between low shrinking portions and high shrinking portions in the individual filaments.

Comparative Example 2

The same procedures as those described in Comparative Example 1 were carried out except that the taking up speed was 4,500 m/min.

The resultant multifilament yarn exhibited an Uster unevenness of the thickness of the yarn, in the type as shown in FIG. 5B and had the properties and dimensions as shown in Table 6.

TABLE 6

| Individual filament $n_1 \times m_1$ / $n_2 \times m_2$ | Multifilament yarn: Tensile strength (g/d) | Wet shrinkage in boiling water (%) | Dry shrinkage at 120° C. (%) | Stress-strain curve: $L_1$ (%) | $L_2$ (%) | $L_1 - L_2$ (%) |
|---|---|---|---|---|---|---|
| 2.0 | 3.3 | 35 | 32 | 100 | 75 | 25 |

The resultant multifilament yarn was converted to a dyed knitted fabric in the same manner as that described in Example 1.

The resultant dyed, knitted fabric exhibited a considerable bulkiness. However, this considerable bulkiness was very unstable and was easily eliminated by applying a tension to the fabric.

Referential Example 1

A multifilament yarn produced by the same procedures as those described in Example 1 was converted to 6 hanks each having a denier of 3,000.

A comparative multifilament yarn produced by the same process as that described in Comparative Example 2 was converted to 6 hanks each having a denier of 3,000.

The above-mentioned hanks and comparative hanks were heat-treated at a temperature of 120° C. for five minutes under a load of 0, 2.5, 5.0, 7.5, 10, or 15 mg/d.

Each of the heat-treated hanks and comparative hanks were converted to a dyed knitted fabric or comparative fabric in the same manner as that described in Example 1. The bulkiness of the resultant fabrics was observed by unaided visual observation. The results are shown in Table 7.

TABLE 7

| Load (mg/d) | Bulkiness: Fabric produced from multifilament yarn of Example 1 | Comparative fabric produced from multifilament yarn of Comparative Example 2 |
|---|---|---|
| 0 | Excellent | Excellent |
| 2.5 | Excellent | Good |
| 5.0 | Good | Satisfactory |
| 7.0 | Good | Unsatisfactory |
| 10.0 | Satisfactory | Unsatisfactory |
| 15.0 | Satisfactory | Unsatisfactory |

Table 7 shows that the multifilament yarn of the present invention has an excellent heat shrinking property and can impart a high bulkiness to a final product even if the heat-treatment is carried out under tension.

Examples 6 to 10

In each of Examples 6 to 10, an undrawn multifilament yarn consisting of the same polyester as that described in Example 1 was produced under the melt spinning conditions indicated in Table 9 by using a spinneret having 36 orifices as specified in Table 8 and the undrawn yarn was drawn-heat set under the conditions shown in Table 9.

TABLE 8

| Example No. | Item: First orifice segment: Outer diameter $lA_\omega$ (mm) | Inner diameter $lB_\omega$ (mm) | Width of arc-shaped slits $\frac{(lA_\omega - lB_\omega)}{2}$ (mm) | Second orifice segment: Diameter $lA_2$ | Third orifice segment: Width (w) | Length (l) | Ratio $S_1/S_2$ (*) |
|---|---|---|---|---|---|---|---|
| 6 | 1.00 | 0.80 | 0.10 | 0.30 | 0.05 | 0.70 | 4.0 |
| 7 | 1.00 | 0.80 | 0.10 | 0.30 | 0.05 | 0.70 | 4.0 |
| 8 | 0.55 | 0.35 | 0.10 | 0.30 | 0.05 | 0.70 | 1.7 |
| 9 | 1.00 | 0.80 | 0.10 | 0.25 | 0.05 | 0.70 | 5.8 |
| 10 | 0.50 | 0.40 | 0.05 | 0.15 | 0.05 | 0.70 | 3.6 |

TABLE 9

| Example No. | Item: Melt spinning: Ratio in flow velocity ($V_1/V_2$) | Taking up speed (m/min) | Draw-heat setting: Preheating temperature (°C.) | Heat setting temperature (°C.) | Draw ratio | Withdrawing speed (m/min) |
|---|---|---|---|---|---|---|
| 1 | 1/3.3 | 3500 | 80 | 180 | 1.3 | 500 |

TABLE 9-continued

| Example No. | Item: Melt spinning: Ratio in flow velocity ($V_1/V_2$) | Melt spinning: Taking up speed (m/min) | Draw-heat setting: Preheating temperature (°C.) | Draw-heat setting: Heat setting temperature (°C.) | Draw-heat setting: Draw ratio | Draw-heat setting: Withdrawing speed (m/min) |
|---|---|---|---|---|---|---|
| 7 | 1/3.3 | 2500 | 80 | 180 | 1.6 | 500 |
| 8 | 1/3.3 | 3000 | 80 | 180 | 1.4 | 500 |
| 9 | 1/2.3 | 3000 | 80 | 180 | 1.4 | 500 |
| 10 | 1/3.4 | 3000 | 80 | 180 | 1.4 | 500 |

In each of Examples 6 to 10, the melt spinning procedures were carried out smoothly without breakage of the individual filaments. The resultant drawn-heat set yarn had a yarn count of 75 deniers/36 filaments.

The properties and dimensions of the yarn are shown in Table 10.

TABLE 10

| Example No. | Individual filament: Cross-sectional area of hollow (%) | Individual filament: $\frac{n_1 \times m_1}{n_2 \times m_2}$ | Individual filament: Sg/Sh | Multifilament yarn: Tensile strength (g/d) | Multifilament yarn: Wet shrinkage in boiling water (%) | Multifilament yarn: Dry shrinkage at 120° C. (%) | Stress-strain curve: $L_1$ (%) | Stress-strain curve: $L_2$ (%) | Stress-strain curve: $L_1 - L_2$ (%) |
|---|---|---|---|---|---|---|---|---|---|
| 6 | 10 | 2.5 | 1.4 to 1.6 | 2.5 | 17 | 17 | 145 | 30 | 115 |
| 7 | 9 | 2.3 | 1.4 to 1.6 | 2.7 | 13 | 15 | 100 | 32 | 68 |
| 8 | 8 | 3.5 | 1.0 to 1.1 | 2.4 | 21 | 24 | 175 | 32 | 143 |
| 9 | 10 | 2.3 | 1.5 to 1.9 | 3.0 | 15 | 17 | 90 | 35 | 55 |
| 10 | 8 | 2.9 | 1.0 to 1.3 | 2.5 | 16 | 12 | 135 | 33 | 102 |

The dyed knitted fabrics produced from the multifilament yarns in the same manner as that described in Example 1 had an even brilliant color and an excellent bulkiness.

Example 11 and Comparative Example 3

In Example 11, the same procedures as those described in Example 2 were carried out except that the polyethylene terephthalate resin was replaced by a polybutylene terephthalate resin having an intrinsic viscosity of 0.87, the melt spinning procedure as carried out at a temperature of 280° C. at an extruding rate of 27.1 g/min, at a taking up speed of 2,500 m/min, and the drawn-heat setting procedure was carried out at a draw ratio of 1.30. The resultant multifilament yarn had a yarn count of 75 deniers/36 filaments.

In Comparative Example 3, the same polybutylene terephthalate resin as mentioned above was extruded through a spinneret being provided with 36 round orifices each having a diameter of 0.30 mm, and a land length of 0.60 mm, at an extruding rate of 19.2 g/min. The resultant undrawn multifilament yarn was taken up at a speed of 1,000 m/min. The undrawn filaments were preheated at a temperature of 60° C. and drawn-heat set at a temperature of 180° C. at a draw ratio of 2.3 by using a slit heater, and the resultant drawn yarn was withdrawn at a speed of 500 m/min.

The bulkiness of the above-mentioned multifilament yarns was tested in the same manner as that described in Example 1. The properties of the multifilament yarns are shown in Table 11.

TABLE 11

| Example No. | Item: Cross-sectional area of hollow (%) | Item: Yarn: Tensile strength (g/d) | Item: Yarn: Ultimate elongation (%) | Item: Yarn: Uster uneveness (%) | Item: Fabric: Bulkiness | Item: Fabric: Touch | Item: Fabric: Appearance |
|---|---|---|---|---|---|---|---|
| Example 11 | 16 | 2.5 | 30 | 7.2 | Excellent | Similar to spun yarn fabric | Similar to spun yarn fabric |
| Comparative Example 3 | 0 | 3.5 | 28 | 1.1 | None | Slimy | Metallic gloss |

Example 12

The same procedures as those described in Example 2 were carried out except that the solidified filaments were subjected to an interlacing procedure in which an air jet was blown from an interlace nozzle toward the filaments at an overfeed of 2% under a pressure of 5 $Kg/cm^2$ to an extent that the filaments were interlaced at the number of interlacings of 35 interlacings/m, and the interlaced filaments were then taken up.

The resultant interlaced multifilament yarn had a distribution of heat shrinkages of the type shown in FIG. 8A. The difference between the maximum shrinkage and the minimum shrinkage found on the multifilament yarn was about 20%. The bulkiness test for the interlaced multifilament yarn was carried out in the same manner as that described in Example 1.

The dyed knitted fabric had an even brilliant color, a feather-like appearance, an excellent bulkiness, and a spun yarn fabric-like touch.

EXAMPLES 13 to 16

In each of Examples 13 to 16, the same procedures as those described in Example 1 were carried out except that the spinning orifices were of the dimensions shown in Table 12. In Example 14, the spinneret had three types of orifices each having a different length l of the third orifice segment as shown in Table 12. Also, in Example 15, the spinneret had three types of orifices each having a different diameter $lA_2$ of the second orifice segment, as shown in Table 12. Furthermore, in Example 16, the spinneret had two types of orifices each having different dimensions of the first orifice segment as shown in Table 12.

The results are shown in Table 13.

TABLE 12

| Example No. | Item: First orifice segment: Outer diameter $lA_\omega$ (mm) | Inner diameter $lB_\omega$ (mm) | Width of arc-shaped slits $\frac{(lA_\omega - lB_\omega)}{2}$ (mm) | Second orifice segment: Diameter $lA_2$ (mm) | Third orifice segment: Width w (mm) | Length l (mm) | Ratio $S_1/S_2$ (*) | Number of orifices | Ratio in flow velocity $(V_1/V_2)$ |
|---|---|---|---|---|---|---|---|---|---|
| 13 | 1.00 | 0.80 | 0.10 | 0.30 | 0.05 | 0.70 | 4.0 | 36 | 1/3.3 |
| 14 | 1.00 | 0.80 | 0.10 | 0.30 | 0.05 | 0.70 | 4.0 | 12 | — |
| | | | | | | 0.50 | | 12 | |
| | | | | | | 0.30 | | 12 | |
| 15 | 1.00 | 0.80 | 0.10 | 0.30 | 0.05 | 0.70 | 4.0 | 12 | 1/3.3 |
| | | | | 0.27 | | | 4.7 | 12 | 1/2.7 |
| | | | | 0.25 | | | 5.8 | 13 | 1/2.3 |
| 16 | 1.00 | 0.80 | 0.10 | 0.27 | 0.05 | 0.70 | 4.7 | 18 | — |
| | 0.97 | 0.83 | 0.07 | 0.15 | 0.05 | 0.70 | 11.2 | 18 | 1.7 |

TABLE 13

| Example No. | Item: Individual filament: $\frac{n_1 \times m_1}{n_2 \times m_2}$ | Sg/Sh | Multifilament yarn: Tensile strength (g/d) | Wet shrinkage in boiling water (%) | Dry shrinkage at 120° C. (%) | Stress-strain curve: $L_1$ (%) | $L_2$ (%) | $L_1 - L_2$ (%) | Bulkiness | Evenness of dyeing property |
|---|---|---|---|---|---|---|---|---|---|---|
| 13 | 2.5 | 1.4 to 1.6 | 2.7 | 34 | 30 | 240 | 75 | 165 | Excellent | Satisfactory |
| 14 | 3.0 | 1.4 to 1.6 | 2.7 | 35 | 33 | 220 | 73 | 147 | Excellent | Excellent |
| 15 | 3.7 | 1.4 to 1.6 | 2.8 | 30 | 27 | 200 | 75 | 125 | Excellent | Excellent |
| 16 | 4.5 | 1.5 to 1.8 | 2.6 | 32 | 35 | 210 | 78 | 132 | Excellent | Good |

EXAMPLES 17 to 19

In each of Examples 17 to 19, the same procedures as those described in Example 1 were carried out except that two different polyester resin melts as shown in Table 14 were extruded through the first and second orifice segments respectively, and the resultant multifilament yarn had a yarn count of 75 deniers/24 filaments.

The results are shown in Table 15.

TABLE 15

| Example No. | Item: Multifilament yarn: Tensile strength (g/d) | Wet shrinkage in boiling water (%) | Stress-strain curve: $L_1$ (%) | $L_2$ (%) | $L_1 - L_2$ (%) | Fabric Bulkiness |
|---|---|---|---|---|---|---|
| 17 | 2.8 | 34 | 237 | 73 | 164 | Excellent |
| 18 | 2.7 | 24 | 236 | 74 | 162 | Excellent |
| 19 | 2.7 | 16 | 235 | 74 | 161 | Good |

We claim:

1. A synthetic polymer hollow irregular multifilament yarn capable of being converted to a bulky yarn, consisting of a plurality of hollow irregular individual filaments, each of which filaments comprises (A) a hollow filamentary constituent extending along the longitudinal axis of the filament and having at least one hollow extending therealong;

(B) a non-hollow sinuous filamentary constituent sinuously extending in a wave form along the hollow filamentary constituent (A) and having an average

TABLE 14

| Example No. | Item: Orifice segment | Type of polymer | Intrinsic viscosity | Shrinkage in boiling water (%) |
|---|---|---|---|---|
| 17 | First | Ethylene terephthalate-isophthalate copolyester (90:10 by mole) | 0.64 | 45 |
| | Second | Polyethylene terephthalate | 0.71 | 15 |
| 18 | First | Ethylene terephthalate-isophthalate copolyester (98:2 by mole) | 0.64 | 27 |
| | Second | Polyethylene terephthalate | 0.71 | 15 |
| 19 | First | Polyethylene terephthalate | 0.64 | 18 |
| | Second | Polyethylene terephthalate | 0.71 | 15 |

thickness smaller than that of the hollow filamentary constituent (A); and (C) a middle filamentary constituent distortedly extending along the hollow filamentary constituent (A), while connecting therethrough the non-hollow sinuous filamentary constituent (B) to one side of the hollow filamentary constituent (A) to provide a body of hollow irregular filament having a thickness varying along the longitudinal axis of the filament, and having a cross-sectional profile in the form of a waist formed between the hollow filamentary constituent (A) and the non-hollow sinuous filamentary constituent (B).

2. The hollow irregular multifilament yarn as claimed in claim 1, wherein the hollow filamentary constituent (A) has a higher degree of orientation than that of the non-hollow sinuous filamentary constituent (B).

3. The hollow irregular multifilament yarn as claimed in claim 1, wherein the individual filament has a cocoon-shaped cross-sectional profile which is asymmetrical about a waist axis of the middle filamentary constituent (C).

4. The hollow irregular multifilament yarn as claimed in claim 1, wherein the hollow filamentary constituent (A) has a cross-sectional profile in the form of an opened fan widening from an end thereof adjacent to the middle filamentary constituent (C) to the opposite end thereof.

5. The hollow irregular multifilament yarn as claimed in claim 1, wherein the variation in the thicknesses of the individual filaments is periodical.

6. The hollow irregular multifilament yarn as claimed in claim 5, wherein the periodicities in the variation of the thicknesses of the individual filaments are different.

7. The hollow irregular multifilament yarn as claimed in claim 1, wherein the individual filaments are interlaced.

8. The hollow irregular multifilament yarn as claimed in claim 1, wherein in a cross section of the multifilament yarn, the cross-sectional profiles of the individual filaments in the yarn satisfy the relationship (I) indicated below:

$$\frac{n_1 \times m_1}{n_2 \times m_2} \geqq 1.5 \qquad \text{(I)}$$

wherein in the major axes and the minor axes of the cross-sectional profiles of the individual filaments found in a cross-section of the multifilament yarn, $n_1$ represents a length of the largest major axis, $m_1$ represents a length of the largest minor axis, $n_2$ represents a length of the smallest major axis, and $m_2$ represents a length of the smallest minor axis.

9. The hollow irregular multifilament yarn as claimed in claim 1, wherein the multifilament yarn satisfies the relationship II indicated below:

$$L_1 - L_2 \geqq 20\% \qquad \text{(II)}$$

wherein $L_1$ represents an ultimate elongation in percent of the multifilament yarn and $L_2$ represents an elongation in percent of the multifilament yarn at which elongation the multifilament yarn exhibits a maximum stress.

10. The hollow irregular multifilament yarn as claimed in claim 1, wherein the individual filaments consist essentially of a polyester resin.

11. The hollow irregular multifilament yarn as claimed in claim 10, wherein the polyester resin comprises at least one member selected from the group consisting of polyethylene terephthalate and polybutylene terephthalate.

12. The hollow irregular multifilament yarn as claimed in claim 1, wherein the hollow filamentary constituent (A) and the non-hollow sinuous filamentary constituent (B) respectively consist essentially of a first synthetic polymeric resin and a second synthetic polymeric resin different from each other.

13. The hollow irregular multifilament yarn as claimed in claim 12, wherein the first and second synthetic polymers are compatible with each other.

14. The hollow irregular multifilament yarn as claimed in claim 1, wherein the hollow filamentary constituent (A) exhibits a higher heat-shrinking property than that of the non-hollow filamentary constituent (B).

15. The hollow irregular multifilament yarn as claimed in claim 12, wherein the hollow filamentary constituent (A) comprising the first polymer exhibits a higher heat-shrinking property than that of the non-hollow sinuous filamentary constituent (B) comprising the second polymer.

16. The hollow irregular multifilament yarn as claimed in claim 12, wherein the first polymeric resin comprises a polyester resin and the second polymeric resin is another polyester resin having a smaller intrinsic viscosity than that of the polyester resin for the first polymeric resin.

* * * * *